US008081894B2

(12) United States Patent
Ashikawa et al.

(10) Patent No.: US 8,081,894 B2
(45) Date of Patent: Dec. 20, 2011

(54) IMAGE FORMING APPARATUS AND METHOD OF CONTROLLING HEATING OF FIXING UNIT THEREIN

(75) Inventors: Yoshihisa Ashikawa, Kanagawa (JP); Keiichi Sanada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 733 days.

(21) Appl. No.: 12/213,858

(22) Filed: Jun. 25, 2008

(65) Prior Publication Data

US 2009/0016759 A1 Jan. 15, 2009

(30) Foreign Application Priority Data

Jul. 9, 2007 (JP) ..... 2007-180130
May 7, 2008 (JP) ..... 2008-121366

(51) Int. Cl.
*G03G 15/02* (2006.01)

(52) U.S. Cl. ..... 399/70; 399/67; 399/69

(58) Field of Classification Search ..... 399/70
See application file for complete search history.

(56) References Cited

U.S. PATENT DOCUMENTS 5,854,957 A * 12/1998 Morikawa ..... 399/38
6,335,797 B1 * 1/2002 Hirosawa ..... 358/1.15
6,829,444 B2 12/2004 Ashikawa
2004/0151516 A1 * 8/2004 Takahashi et al. ..... 399/70
2005/0013623 A1 * 1/2005 Umezawa ..... 399/70
2005/0135828 A1 * 6/2005 Joichi et al. ..... 399/75
2007/0014586 A1 * 1/2007 Kobayashi ..... 399/70
2007/0098419 A1 5/2007 Ashikawa
2008/0019739 A1 * 1/2008 Oouchi ..... 399/301

FOREIGN PATENT DOCUMENTS

JP 09-153968 6/1997
JP 2003-223089 8/2003
JP 2004-146366 5/2004
JP 3651758 3/2005
JP 2006-058824 3/2006
JP 4066410 1/2008

OTHER PUBLICATIONS

English language abstract of JP2000-196789 dated Jul. 14, 2000.
English language abstract of JP2003-323085 dated Nov. 14, 2003.

* cited by examiner

*Primary Examiner* — David Gray
*Assistant Examiner* — David Bolduc
(74) *Attorney, Agent, or Firm* — Harness, Dickey & Pierce, P.L.C.

(57) ABSTRACT

When a user has performed an operation with respect to an image forming apparatus, a control mechanism informs that a user has performed an operation with respect to an image forming apparatus to an engine control unit through a dedicated communication line, i.e., without waiting for a general-purpose communication line to open for communication. Upon receiving the user operation signal, the engine control unit heats a fixing unit.

14 Claims, 8 Drawing Sheets

IMAGE FORMING APPARATUS AND METHOD OF CONTROLLING HEATING OF FIXING UNIT THEREIN

CROSS-REFERENCE TO RELATED APPLICATIONS

The present application claims priority to and incorporates by reference the entire contents of Japanese priority document 2007-180130 filed in Japan on Jul. 9, 2007 and 2008-121366 filed in Japan on May 7, 2008.

BACKGROUND OF THE INVENTION

1. Field of the Invention

The present invention relates to an image forming apparatus and a method of controlling heating of a fixing unit therein.

2. Description of the Related Art

Conventionally, in an image forming apparatus, a control unit and an engine control unit communicate signals regarding various information through a communication bus. When a power supply to the image forming apparatus is turned ON, or when the image forming apparatus returns to a normal mode from an energy saving mode, the communication bus is opened for communication such that heating of a fixing unit can be controlled based on the signals communicated through the communication bus. More particularly, the control unit determines whether it is necessary to heat the fixing unit and accordingly transmits an instruction to the engine control unit through the communication bus. Based on that instruction, the engine control unit controls heating of the fixing unit. Thus, to receive an instruction from the control unit, the engine control unit needs to wait for the communication bus to open. That results in slowing down the process of image forming.

To solve such a problem, Japanese Patent Application Laid-Open No. 2006-58824 discloses a technique in which an engine control unit independently controls heating of a fixing unit. That is, the engine control unit measures the temperature of the fixing unit and, when the temperature falls below a predetermined fixing temperature, controls heating of the fixing unit. Thus, it is possible to speedily activate the fixing unit.

However, if the temperature of the fixing unit is determined to be less than the predetermined fixing temperature when the power supply to the image forming apparatus is turned ON, or when the image forming apparatus returns to a normal mode from an energy saving mode, then the engine control unit controls heating of the fixing unit even if there is no instruction for image formation. That results in unnecessary power consumption.

SUMMARY OF THE INVENTION

It is an object of the present invention to at least partially solve the problems in the conventional technology.

According to an aspect of the present invention, there is provided an image forming apparatus including a fixing unit that when heated fixes a toner image on a recording medium; a detecting unit that generates a detection signal when an operation is performed with respect to the image forming apparatus, the detection signal including a user operation signal indicating that the operation is a user operation; an engine control unit that controls operation of the fixing unit; a control unit that receives the detection signal from the detecting unit and communicates with the engine control unit; a general-purpose communication line that connects the engine control unit and the control unit, the engine control unit and the control unit being able to communicate after the general-purpose communication line is opened for communication; and a dedicated communication line that connects the engine control unit and the control unit. Upon receiving a user operation signal from the detecting unit, the control unit transmits the user operation signal to the engine control unit through the dedicated communication line without waiting for the general-purpose communication line to open for communication. Upon receiving the user operation signal from the control unit, the engine control unit controls heating of the fixing unit.

According to another aspect of the present invention, there is provided a method of controlling heating of a fixing unit in an image forming apparatus that includes a fixing unit that when heated fixes a toner image on a recording medium; a detecting unit that generates a detection signal when an operation is performed with respect to the image forming apparatus, the detection signal including a user operation signal indicating that the operation is a user operation; an engine control unit that controls operation of the fixing unit; a control unit that receives the detection signal from the detecting unit and communicates with the engine control unit; a general-purpose communication line that connects the engine control unit and the control unit, the engine control unit and the control unit being able to communicate after the general-purpose communication line is opened for communication; and a dedicated communication line that connects the engine control unit and the control unit. The method includes the control unit transmitting, upon receiving a user operation signal from the detecting unit, the user operation signal to the engine control unit through the dedicated communication line without waiting for the general-purpose communication line to open for communication; and the engine control unit controlling, upon receiving the user operation signal from the control unit, heating of the fixing unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a timing diagram for explaining exemplary timings at which the control unit and the engine control unit perform various operations when the main power supply is turned ON;

DETAILED DESCRIPTION OF THE PREFERRED EMBODIMENTS

Exemplary embodiments of the present invention are described in detail below with reference to the accompanying drawings. The present invention is not limited to these exemplary embodiments.

An image forming apparatus according to the present invention is described with reference to an MFP that has various functions such as a copying function, a facsimile (FAX) function, a printing function, a scanning function, and a distributing function for distributing a scanned image, a printed image, or a faxed image.

Figure 1:
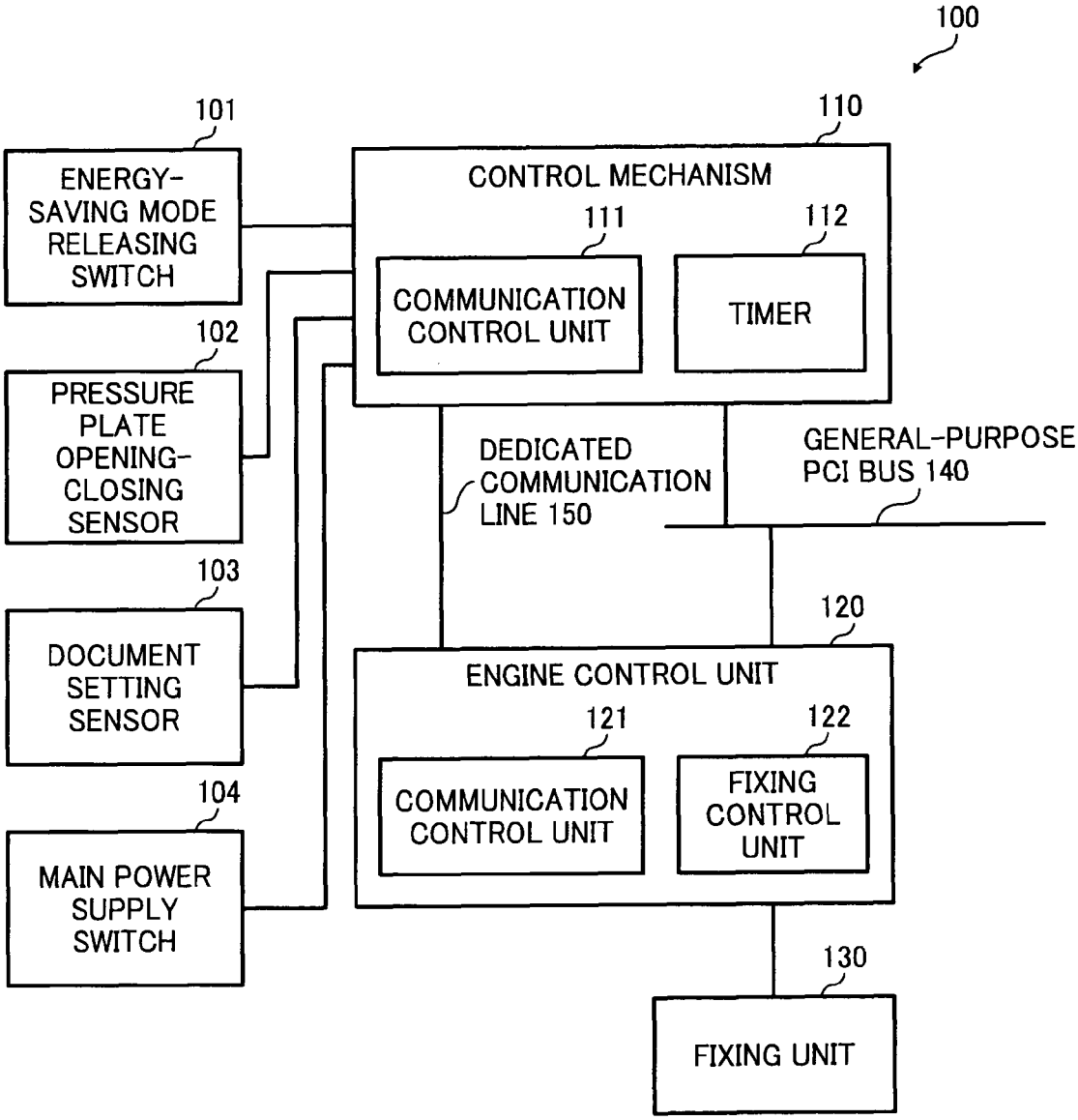
FIG. 1 is a block diagram of a multifunction product (MFP) according to an embodiment of the present invention.

FIG. 1 is a block diagram of an MFP 100 according to an embodiment of the present invention. The MFP 100 includes an energy-saving mode releasing switch 101, a pressure plate opening-closing sensor 102, a document setting sensor 103, a main power supply switch 104, a control mechanism 110, an engine control unit 120, and a fixing unit 130. The control mechanism 110 and the engine control unit 120 are connected to each other with both a general-purpose PCI bus 140 and a dedicated communication line 150.

The energy-saving mode releasing switch 101 is used to instruct the MFP 100 to return to a normal mode from an energy saving mode. During the energy saving mode, the power supply to the fixing unit 130, an operating panel (not shown), and the like is stopped entirely or reduced. During the normal mode, the power is supplied to the entire MFP 100. When the energy-saving mode releasing switch 101 is activated, the energy-saving mode releasing switch 101 sends a detection signal to the control mechanism 110.

The pressure plate opening-closing sensor 102 detects opening and closing of a pressure plate (not shown) that is arranged to press a document placed on an exposure glass (not shown) such that a reading unit (not shown) can read the document. When the pressure plate opening-closing sensor 102 detects opening or closing of the pressure plate, the pressure plate opening-closing sensor 102 sends a detection signal to the control mechanism 110.

The document setting sensor 103 detects a document when set in an automatic document feeder (ADF). When the document setting sensor 103 detects a document, the document setting sensor 103 sends a detection signal to the control mechanism 110.

The energy-saving mode releasing switch 101, the pressure plate opening-closing sensor 102, and the document setting sensor 103 are detecting units that detect different operations performed by a user with respect to the MFP 100. More particularly, because a user operates the energy-saving mode releasing switch 101, it is possible to detect switching ON or switching OFF the energy-saving mode releasing switch 101. The pressure plate opening-closing sensor 102 detects a user operation of opening or closing the pressure plate, while the document setting sensor 103 detects a user operation of placing a document in the ADF. Thus, when the control mechanism 110 receives a signal from these units, it means that a user has performed an operation with respect to the MFP 100.

The main power supply switch 104 is used to start or stop the power supply to the MFP 100 from a main power supply (not shown).

The control mechanism 110 controls the entire MFP 100 including the energy-saving mode releasing switch 101, the pressure plate opening-closing sensor 102, the document setting sensor 103, the main power supply switch 104, and the engine control unit 120. The control mechanism 110 includes a communication control unit 111 and a timer 112.

The timer 112 measures the elapse in time after image forming setting is performed for the fixing unit 130. The image forming setting includes setting of control parameters of the fixing unit 130, a photosensitive member (not shown), and the like based on environmental conditions (e.g., temperature and humidity) inside or around the MFP 100.

The communication control unit 111 is connected to the energy-saving mode releasing switch 101, the pressure plate opening-closing sensor 102, the document setting sensor 103, and the main power supply switch 104, and receives signals therefrom. Depending on the received signals, the communication control unit 111 sets a value in a normal-mode return triggering signal and a normal mode determining signal, and transmits the normal-mode return triggering signal and the normal mode determining signal to the engine control unit 120 through the dedicated communication line 150.

The normal-mode return triggering signal indicates whether the MFP 100 has returned to the normal mode from the energy saving mode because of a user operation. Upon receiving a signal from any one of the energy-saving mode releasing switch 101, the pressure plate opening-closing sensor 102, and the document setting sensor 103, the communication control unit 111 sets "0 (low)" in the normal-mode return triggering signal. The value "0 (low)" in the normal-mode return triggering signal indicates that a user has performed an operation with respect to the MFP 100. When a signal is not received from any one of the energy-saving mode releasing switch 101, the pressure plate opening-closing sensor 102, and the document setting sensor 103, the communication control unit 111 sets "1 (high)" in the normal-mode return triggering signal. The value "1 (high)" in the normal-mode return triggering signal indicates that a user has not performed an operation with respect to the MFP 100 and the MFP 100 has been accessed though a network for, e.g., data transmission. A user operation signal indicates that the MFP 100 has returned to the normal mode from the energy saving mode when "0 (low)" is set in the normal-mode return triggering signal, i.e., when a user operates the MFP 100. Meanwhile, the MFP 100 can also be configured such that the value "0 (low)" is set in the normal-mode return triggering signal when a user operates a switch or a sensor other than the abovementioned switches and sensors, and a signal is transmitted therefrom.

The normal mode determining signal indicates whether the MFP 100 has returned to the normal mode from the energy saving mode. When the MFP 100 is determined to be in the normal mode because of switching ON the main power supply switch 104, i.e., because of turning ON the main power supply, the communication control unit 111 sets "0 (low)" in the normal mode determining signal. On the other hand, when the MFP 100 is determined to have returned to the normal mode from the energy saving mode, the communication control unit 111 sets "1 (high)" in the normal mode determining signal.

The communication control unit 111 also transmits a control mechanism booting signal, which indicates whether the control mechanism 110 has booted, to the engine control unit 120 through the dedicated communication line 150. When the control mechanism 110 is determined not to have booted, the communication control unit 111 sets "0 (low)" in the control mechanism booting signal. When the control mechanism 110 is determined to have booted, the communication control unit 111 sets "1 (high)" in the control mechanism booting signal. More particularly, after turning ON the main power supply, when the power input to the control mechanism 110 is stepped down to 3.3 volts, the control mechanism booting signal is switched from "0 (low)" to "1 (high)". Unless the main power supply is turned OFF, the communication control unit 111 continues to transmit the control mechanism booting signal with "1 (high)" set therein to the engine control unit 120 through the dedicated communication line 150.

Moreover, based on the elapse in time measured by the timer after the image forming setting is performed, the communication control unit 111 sets a value in an elapsed time signal and transmits the elapsed time signal to the engine control unit 120 through the dedicated communication line 150. The elapsed time signal indicates whether the elapse in time after the previous image forming setting has exceeded a predetermined time period. If the elapse in time is determined to have exceeded the predetermined time period, the communication control unit sets "1 (high)" in the elapsed time signal. On the other hand, if the elapse in time is determined to not have exceeded the predetermined time period, the communication control unit sets "0 (low)" in the elapsed time signal.

When the main power supply is turned ON or when the MFP 100 returns to the normal mode from the energy saving mode, and after the control mechanism 110 and the engine control unit 120 are activated, the control mechanism 110 opens the general-purpose PCI bus 140 for communication by following a predetermined procedure. Thus, after the general-purpose PCI bus 140 is opened for communication, the control mechanism 110 and the engine control unit 120 communicate information therethrough.

The dedicated communication line 150 is a communication line between the communication control unit 111 in the control mechanism 110 and a communication control unit 121 in the engine control unit 120. The control mechanism 110 transmits the normal-mode return triggering signal, the normal mode determining signal, the elapsed time signal, and the control mechanism booting signal to the engine control unit 120 through the dedicated communication line 150. Unlike in the case of the general-purpose PCI bus 140, there is no need to open the dedicated communication line 150 for communication such that thereby enabling instant transmission of the signals to the engine control unit 120.

The general-purpose PCI bus 140 is a data transmission path (communication line) of the peripheral components interconnect standard and is used to connect the constituent elements of the MFP 100. Each constituent element including the control mechanism 110 and the engine control unit 120 can communicate with another constituent element through the general-purpose PCI bus 140 by opening it for communication in the corresponding sector. Meanwhile, instead of a general-purpose PCI bus, a data transmission path of another standard can also be used to connect the control mechanism 110 and the engine control unit 120.

The engine control unit 120 controls operations of the fixing unit 130 based on the signals received from the control mechanism 110, and includes the communication control unit 121 and a fixing control unit 122.

The communication control unit 121 receives the normal-mode return triggering signal, the normal mode determining signal, the elapsed time signal, and the control mechanism booting signal from the control mechanism 110 through the dedicated communication line 150. Moreover, after the general-purpose PCI bus 140 is opened for communication, the communication control unit 121 communicates various other signals with the control mechanism 110 therethrough.

The fixing control unit 122 determines, before the general-purpose PCI bus 140 is opened for communication, whether to heat the fixing unit 130 based on the control mechanism booting signal, the normal-mode return triggering signal, the normal mode determining signal, and the elapsed time signal received by the communication control unit 121, and accordingly controls the fixing unit 130.

More particularly, based on the control mechanism booting signal, the fixing control unit 122 determines whether the control mechanism 110 has booted. When the control mechanism 110 is determined to have booted, the fixing control unit 122 controls the fixing unit 130 based on the normal-mode return triggering signal, the normal mode determining signal, and the elapsed time signal. When the control mechanism 110 is determined to have not booted, the fixing control unit 122 does not control the fixing unit 130. That is because the signals received when the control mechanism 110 is yet to boot may include incorrect and unreliable values. Thus, only when the control mechanism 110 has booted and the values in the normal-mode return triggering signal, the normal mode determining signal, and the elapsed time signal are determined to be reliable, the fixing control unit 122 controls the fixing unit 130 based on those received signals.

For example, based on the elapsed time signal, the fixing control unit 122 determines whether to perform the image forming setting for the fixing unit 130. If a certain amount of time elapses after the image forming setting, there is a possibility that the environment surrounding the MFP 100 undergoes changes. Thus, it is desirable to repeat the image forming setting to form a high quality image. That is why the fixing control unit 122 determines whether to perform the image forming setting for the fixing unit 130. The details of determining whether to heat the fixing unit 130 by using the normal-mode return triggering signal, the normal mode determining signal, and the elapsed time signal are described later.

As described above, the control mechanism 110 transmits the normal-mode return triggering signal, the normal mode determining signal, and the elapsed time signal through the dedicated communication line 150. In other words, the control mechanism 110 is able to transmit the abovementioned signals without having to wait for the general-purpose PCI bus 140 to open for communication. Thus, the engine control unit 120 receives those signals earlier than when transmitted through the general-purpose PCI bus 140. As a result, it is possible for the engine control unit 120 to determine whether to heat the fixing unit 130 based on the received signals and accordingly control the fixing unit 130.

After the general-purpose PCI bus 140 is opened for communication, the fixing control unit 122 controls the fixing unit 130 based on the signals received therethrough.

Figure 2:
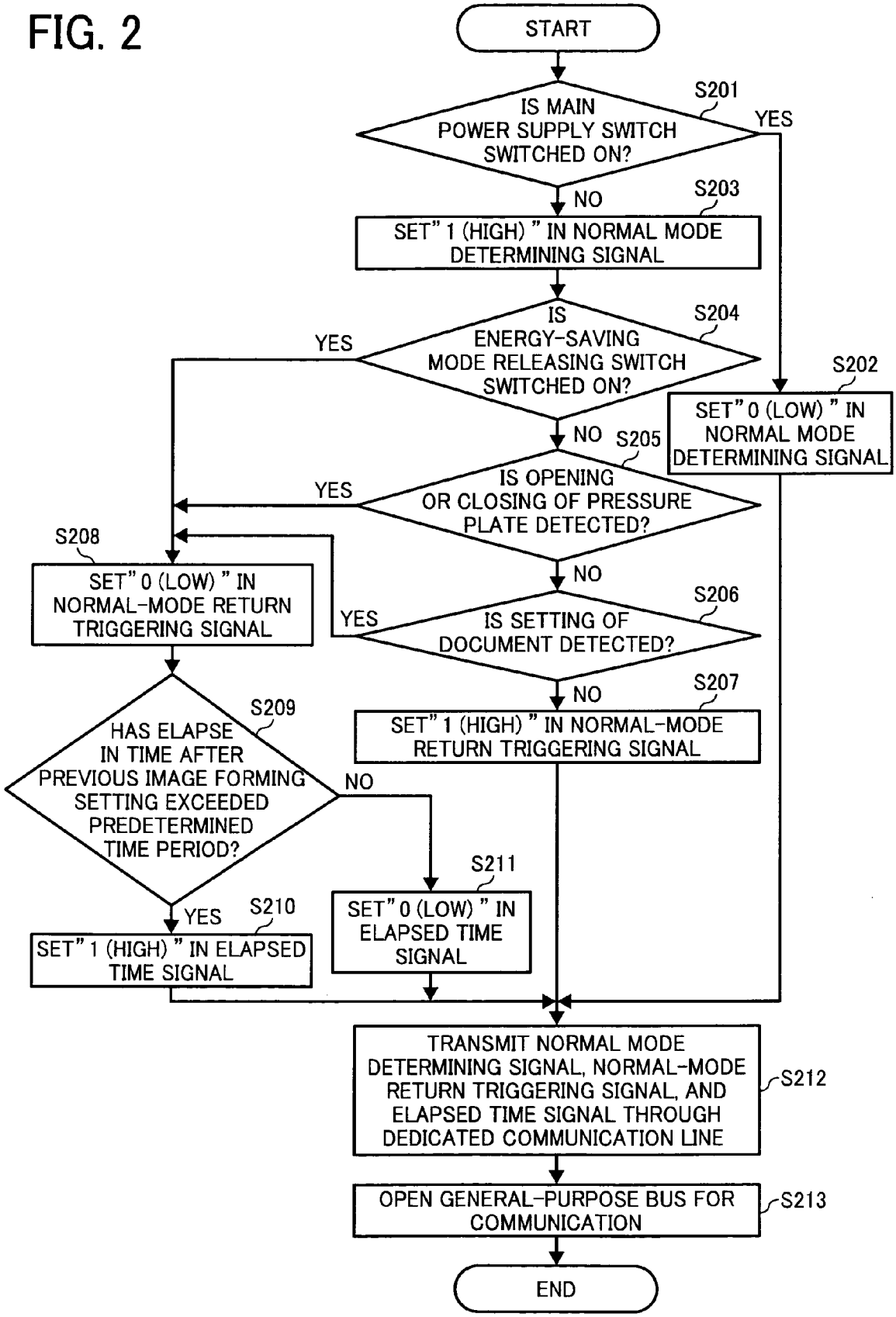
FIG. 2 is a flowchart for explaining a process of transmitting information performed by a communication control unit in a control unit.

FIG. 2 is a flowchart for explaining the process of transmitting information performed by the communication control unit 111. Meanwhile, the description below is given on the premise that "1 (high)" is set in the control mechanism booting signal until the main power supply is turned ON. The communication control unit 111 continues to transmit the control mechanism booting signal to the engine control unit 120 during that period.

First, the communication control unit 111 determines whether a detection signal indicating a user operation of switching ON the main power supply switch 104 is received (Step S201). When it is determined that a detection signal indicating a user operation of switching ON the main power supply switch 104 is received (Yes at Step S201), the communication control unit 111 sets "0 (low)" in the normal mode determining signal (Step S202) and the system control proceeds to Step S212. The value "0 (low)" in the normal mode determining signal indicates that the main power supply is turned ON.

When it is determined that a detection signal indicating a user operation of switching ON the main power supply switch 104 is not received (No at Step S201), the communication control unit 111 sets "1 (high)" in the normal mode determining signal (Step S203). The value "1 (high)" in the normal mode determining signal indicates that the MFP 100 has returned to the normal mode from the energy saving mode. Subsequently, the communication control unit 111 determines whether a detection signal indicating a user operation of switching ON the energy-saving mode releasing switch 101 is received (Step S204). When it is determined that a detection signal indicating a user operation of switching ON the energy-saving mode releasing switch 101 is not received (No at Step S204), the communication control unit 111 determines whether a detection signal, which indicates that the pressure plate opening-closing sensor 102 has detected a user operation of opening or closing the pressure plate, is received (Step S205).

When it is determined that a detection signal, which indicates that the pressure plate opening-closing sensor 102 has detected a user operation of opening or closing the pressure plate, is not received (No at Step S205), the communication control unit 111 determines whether a detection signal indicating that the document setting sensor 103 has detected a document is received (Step S206). When it is determined that a detection signal, which indicates that the document setting sensor 103 has detected a document, is not received (No at Step S206), the communication control unit 111 sets "1 (high)" in the normal-mode return triggering signal (Step S207). The value "1 (high)" in the normal-mode return triggering signal indicates that the MFP 100 has returned to the normal mode from the energy saving mode due to a network access.

When it determined that a detection signal indicating a user operation of switching ON the energy-saving mode releasing switch 101 is received (Yes at Step S204), and when it is determined that a detection signal, which indicates that the pressure plate opening-closing sensor 102 has detected a user operation of opening or closing the pressure plate, is received (Yes at Step S205) or a detection signal, which indicates that the document setting sensor 103 has detected a document, is received (Yes at Step S206), then the communication control unit 111 sets "0 (low)" in the normal-mode return triggering signal (Step S208). The value "0 (low)" in the normal-mode return triggering signal indicates that the MFP 100 has returned to the normal mode from the energy saving mode due to a user operation.

The communication control unit 111 then determines whether the elapse in time after the previous image forming setting measured by the timer 112 has exceeded a predetermined time period (Step S209). When it is determined that the elapse in time has exceeded the predetermined time period (Yes at Step S209), the communication control unit sets "1 (high)" in the elapsed time signal (Step S211). When it is determined that the elapse in time has not exceeded the predetermined time period (No at Step S209), the communication control unit sets "0 (low)" in the elapsed time signal (Step S211).

Subsequently, the communication control unit 111 transmits the normal-mode return triggering signal, the normal mode determining signal, and the elapsed time signal, to the engine control unit 120 through the dedicated communication line 150 (Step S212), and then opens the general-purpose PCI bus 140 for communication with the engine control unit 120 (Step S213). Upon opening the general-purpose PCI bus 140 for communication, the control mechanism 110 and the engine control unit 120 communicate information therethrough.

Figure 3:
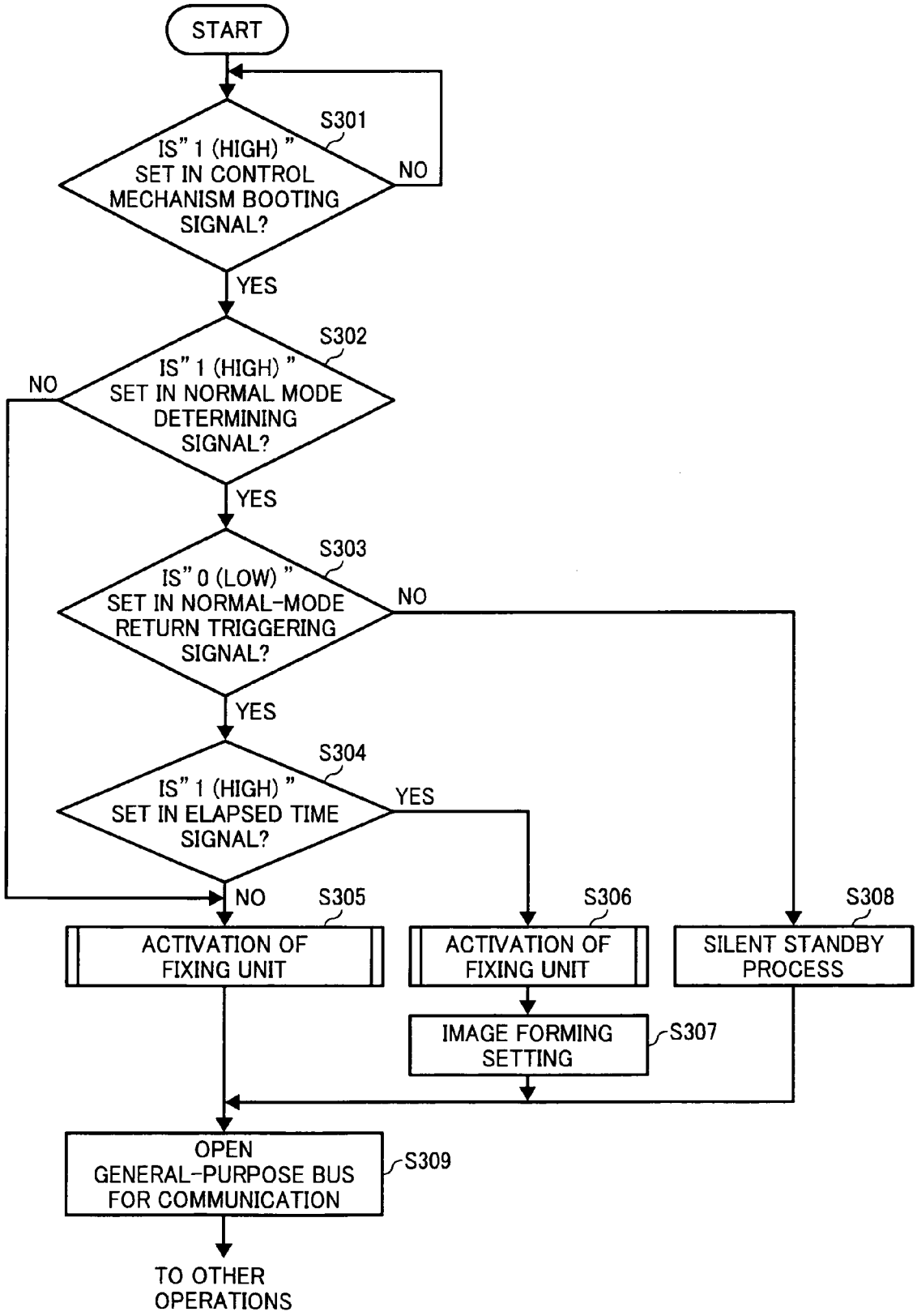
FIG. 3 is a flowchart for explaining a process of controlling heating of a fixing unit performed by an engine control unit shown in FIG. 1.

FIG. 3 is a flowchart for explaining a process of controlling heating of the fixing unit 130 performed by the engine control unit 120 based on the information received from the control mechanism 110.

First, the fixing control unit 122 determines whether "1 (high)" is set in the control mechanism booting signal, which is received by the communication control unit 121 from the control mechanism 110 (Step S301). The value "1 (high)" in the control mechanism booting signal indicates that the control mechanism 110 has booted, while the value "0 (low)" in the control mechanism booting signal indicates that the control mechanism 110 is yet to boot. When it is determined that "1 (high)" is not set in the control mechanism booting signal (No at Step S301), the system control returns to Step S301. In other words, because the signals received when the control mechanism 110 is yet to boot may include incorrect and unreliable values, the engine control unit 120 remains idle until the control mechanism 110 boots.

When it is determined that "1 (high)" is set in the control mechanism booting signal (Yes at Step S301), the fixing control unit 122 determines whether "1 (high)" is set in the normal mode determining signal, which is received by the communication control unit 121 from the control mechanism 110 (Step S302). The value "1 (high)" in the normal mode determining signal indicates that the MFP 100 has returned to the normal mode from the energy saving mode, while the value "0 (low)" in the normal mode determining signal indicates that the main power supply is turned ON. When it is determined that "1 (high)" is not set in the normal mode determining signal (No at Step S302), the system control proceeds to Step S305. When it is determined that "1 (high)" is set in the normal mode determining signal (Yes at Step S302), the fixing control unit 122 determines whether "0 (low)," is set in the normal-mode return triggering signal, which is received by the communication control unit 121 from the control mechanism 110 (Step S303). The value "0 (low)" in the normal-mode return triggering signal indicates that the MFP 100 has returned to the normal mode from the energy saving mode due to a user operation, while the value "1 (high)" in the normal-mode return triggering signal indicates that the MFP 100 has returned to the normal mode from the energy saving mode due to a network access.

When it is determined that "0 (low)" is set in the normal-mode return triggering signal (Yes at Step S303), the fixing control unit 122 determines whether "1 (high)" is set in the elapsed time signal, which is received by the communication control unit 121 from the control mechanism 110 (Step S304). The value "1 (high)" in the elapsed time signal indicates that the elapse in time after the previous image forming setting has exceeded a predetermined time predetermined time, while the value "0 (low)" in the elapsed time signal indicates that the elapse in time has not exceeded the predetermined time period. When it is determined that "1 (high)" is not set in the elapsed time signal (No at Step S304), the fixing control unit 122 performs only a process of activating the fixing unit 130 (Step S305). The process of activating the fixing unit 130 is described below in detail. Meanwhile, even when the main power supply is turned ON by using the main power supply switch 104 (No at Step 302), the fixing control unit 122 performs only the process of activating the fixing unit 130. That is because, when the main power supply is turned ON by using the main power supply switch 104, the control mechanism 110 is yet to boot. Thus, the timer 112 cannot measure the elapse in time after the previous image forming setting. Consequently, it is not possible to determine whether the image forming setting is necessary. Thus, in such a case, the fixing control unit 122 performs only the process of activating the fixing unit 130. Subsequently, after the general-purpose PCI bus 140 is opened for communication, the fixing control unit 122 performs the image forming setting if necessary.

When it is determined that "1 (high)" is set in the elapsed time signal (Yes at Step S304), the fixing control unit 122 performs the process of activating the fixing unit 130 (Step S306) and then performs the image forming setting (Step 307). If a certain amount of time elapses after the image forming setting, there is a possibility that the environment surrounding the MFP 100 undergoes changes. Thus, to form a high quality image, it is desirable to repeat the image forming setting at a predetermined interval.

When it is determined that "0 (low)" is not set in the normal-mode return triggering signal (No at Step S303), the fixing control unit 122 performs a silent standby process (Step S308). When "0 (low)" is not set in the normal-mode return triggering signal, i.e., when the MFP 100 has returned to the normal mode from the energy saving mode due to a network access, there is a possibility that the MFP 100 is instructed to print or store image data transmitted from, e.g., a personal computer through the network. In the case of a printing instruction, the time required to open the general-purpose PCI bus 140 for communication hardly matters because the printing instruction is determined not to be a user operation. In the case of a storing instruction, it is not necessary to heat the fixing unit 130.

Meanwhile, the communication control unit 121 opens the general-purpose PCI bus 140 for communication with the control mechanism 110 (Step S309). Subsequently, the fixing control unit 122 performs operations according to the instructions from the control mechanism 110. Upon opening the general-purpose PCI bus 140 for communication, the fixing control unit 122 communicates with the control mechanism 110 therethrough.

In this way, because the engine control unit 120 receives the normal-mode return triggering signal, the normal mode determining signal, and the elapsed time signal through the dedicated communication line 150 without having to wait for the general-purpose PCI bus 140 to open for communication, it is possible for the engine control unit 120 to determine whether to heat the fixing unit 130 based on the received signals and accordingly heat the fixing unit 130. As a result, it becomes possible to reduce the wait time until the fixing unit 130 is activated for image formation. In this way, by determining whether to heat the fixing unit 130 before the actual process of heating, it is possible to prevent unnecessary heating of the fixing unit 130 thereby saving power consumption.

Meanwhile, instead of using each of the normal-mode return triggering signal, the normal mode determining signal, and the elapsed time signal, the engine control unit 120 can also be configured to determine whether to heat the fixing unit 130 based on one or two of those signals.

Figure 4:
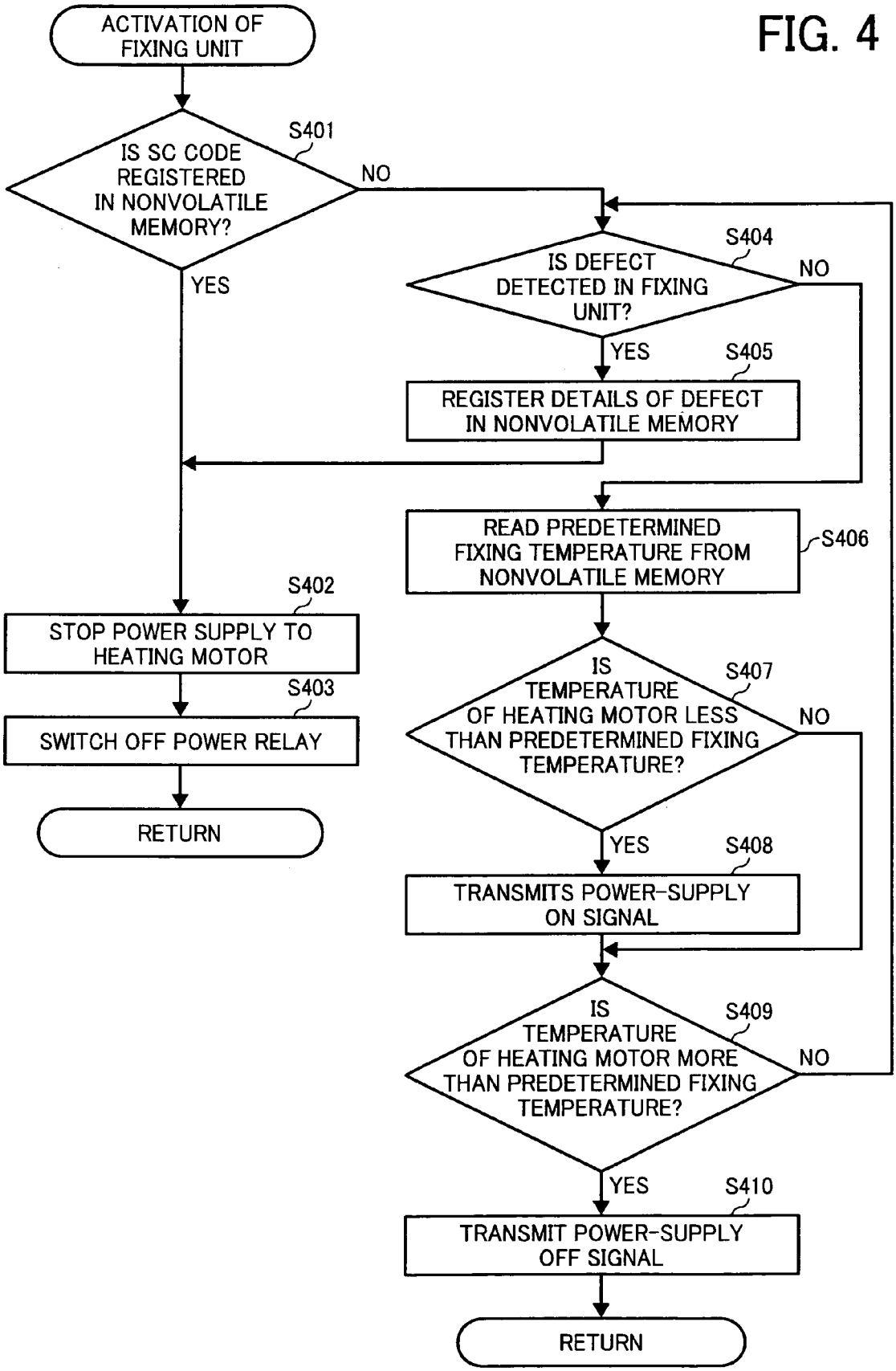
FIG. 4 is a flowchart for explaining a process of activating the fixing unit performed by a fixing control unit in the engine control unit.

FIG. 4 is a flowchart for explaining a process of activating the fixing unit 130 performed by the fixing control unit 122.

First, the fixing control unit 122 determines whether a serviceman call (SC) code is registered in a nonvolatile memory (Step S401). When the SC code is determined to have been registered in the nonvolatile memory (Yes at Step S401), i.e., when there is a defect in the fixing unit 130 to be corrected by a serviceman, the fixing control unit 122 stops supplying the power to a heating motor (not shown), which heats the fixing unit 130, (Step S402) and then switches OFF the power relay (Step S403).

When the SC code is determined not to have been registered in the nonvolatile memory (No at Step S401), the fixing control unit 122 determines whether a defect is detected in the fixing unit 130 (Step S404). When a defect is determined to have been detected in the fixing unit 130 (Yes at Step S404), the fixing control unit 122 registers the details of the defect in the nonvolatile memory (Step S405).

When a defect is determined not to have been detected in the fixing unit 130 (No at Step S404), the fixing control unit 122 reads a predetermined fixing temperature from the nonvolatile memory (Step S406). The fixing control unit 122 then determines whether the temperature of the heating motor is less than the predetermined fixing temperature (Step S407). When the temperature of the heating motor is determined to be less than the predetermined fixing temperature (Yes at Step S407), the fixing control unit 122 transmits a power-supply ON signal to the heating motor (Step S408). When the heating motor is determined not to be less than the predetermined fixing temperature (Yes at Step S407), the system control proceeds to Step S409.

The fixing control unit 122 then determines whether the temperature of the heating motor is more than the predetermined fixing temperature (Step S409). When the heating motor is determined to be more than the predetermined fixing temperature (Yes at Step S409), the fixing control unit 122 transmits a power-supply OFF signal to the heating motor (Step S410).

Figure 5:
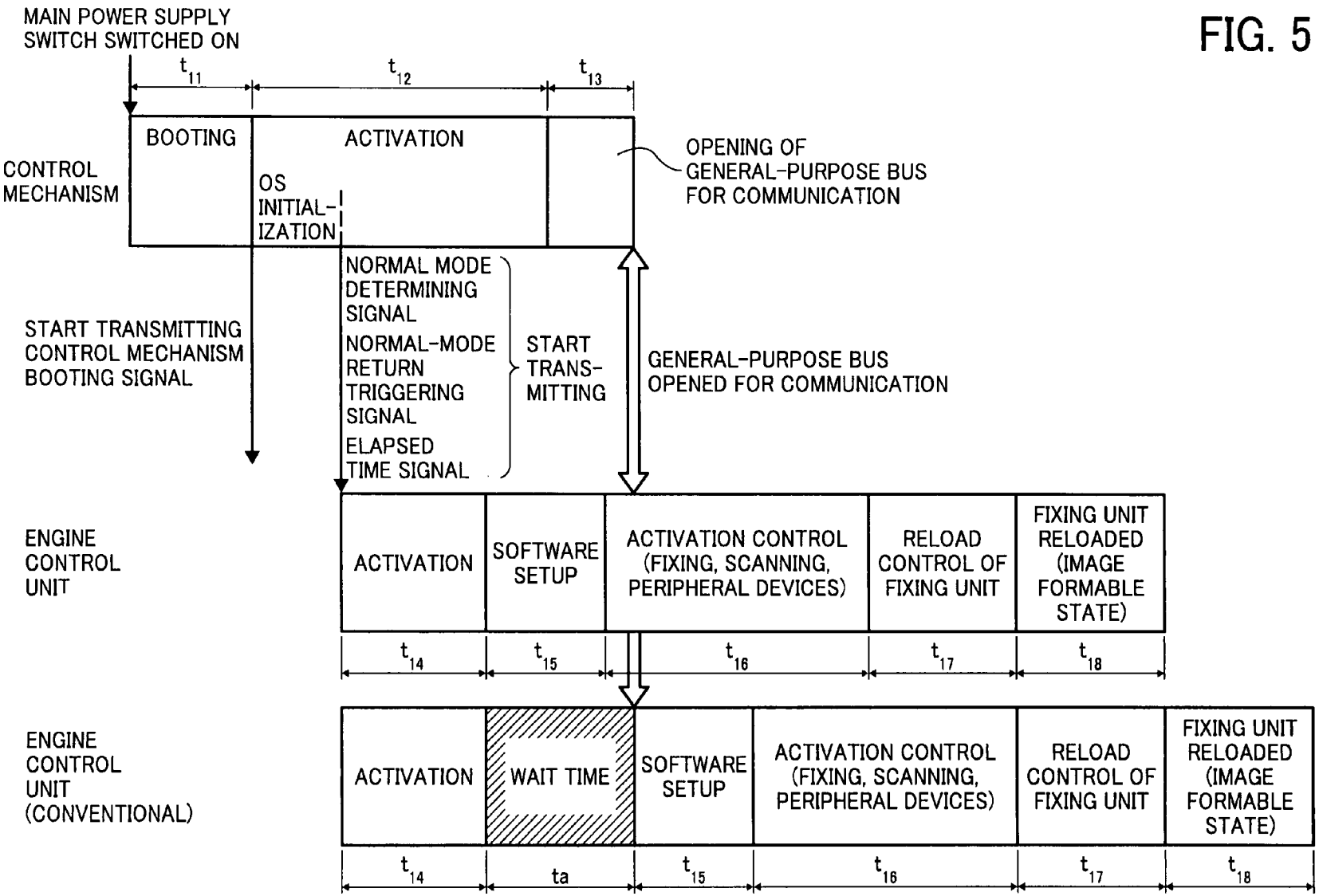

FIG. 5 is a timing diagram for explaining exemplary timings at which the control mechanism 110 and the engine control unit 120 perform various operations when the main power supply is turned ON. When a user switches ON the main power supply switch 104, the control mechanism 110 requires a time period t11 for booting, a time period t12 for activation, and a time period t13 for opening the general-purpose PCI bus 140 for communication. Upon booting, the control mechanism 110 transmits the control mechanism booting signal to the engine control unit 120 through the dedicated communication line 150. Subsequently, when an operating system (OS) is initialized as a part of the activation process, the control mechanism 110 transmits the normal-mode return triggering signal, the normal mode determining signal, and the elapsed time signal to the engine control unit 120 through the dedicated communication line 150.

When the OS in the control mechanism 110 is initialized, the engine control unit 120 starts a process of activation based on an activation instruction, which is transmitted by the control mechanism 110 almost simultaneously with the normal-mode return triggering signal, the normal mode determining signal, and the elapsed time signal. The engine control unit 120 requires a time period t14 for activation and a time period t15 for software setup. The process of controlling heating of the fixing unit 130 described above with reference to FIG. 3 is performed during the software setup. During the process of controlling heating of the fixing unit 130, the normal-mode return triggering signal, the normal mode determining signal, and the elapsed time signal can be referred to when necessary. Moreover, during the process of controlling heating of the fixing unit 130, the engine control unit 120 starts an activation control when it is determined necessary to activate the fixing unit 130.

Figure 6:
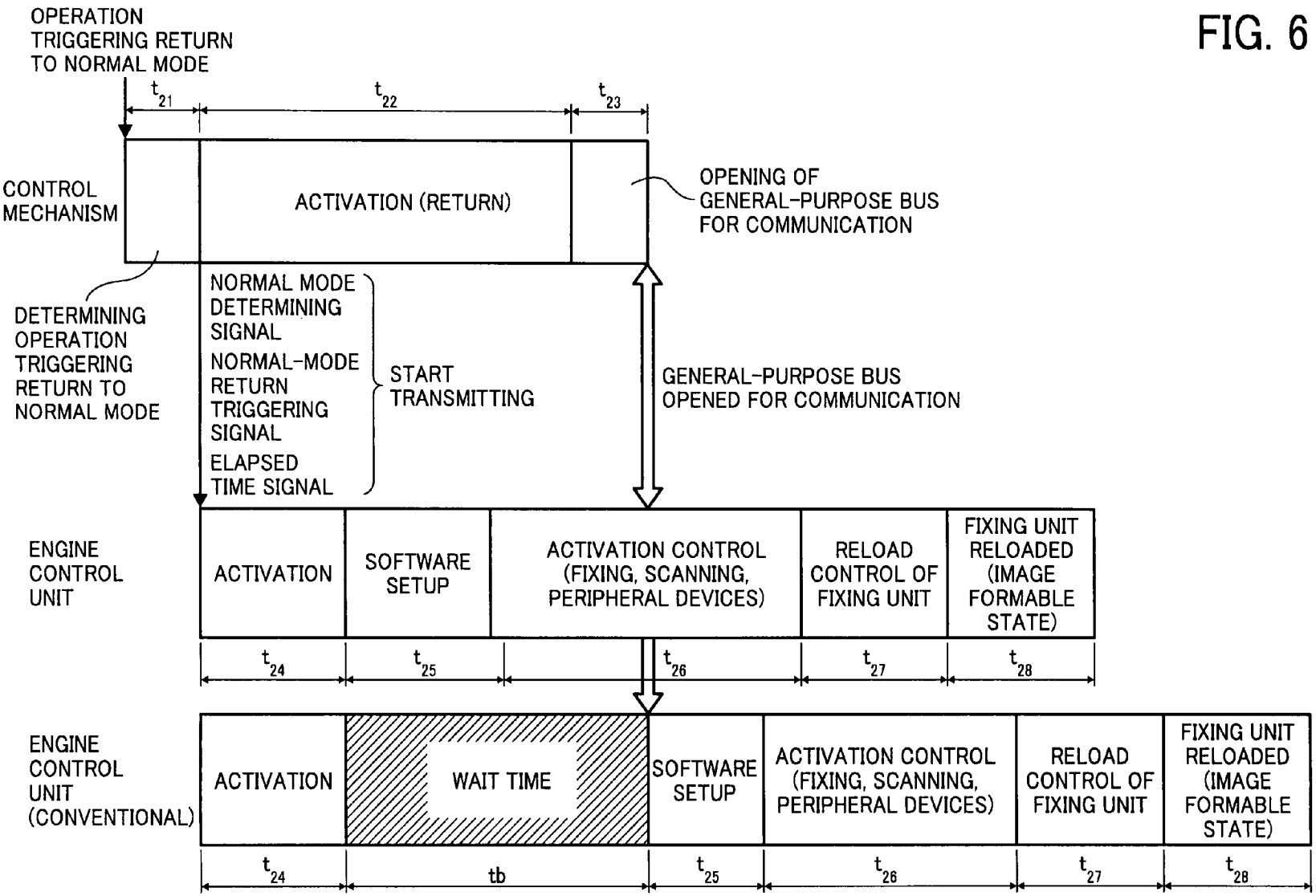
FIG. 6 is a timing diagram for explaining exemplary timings at which the control unit and the engine control unit perform various operations when the MFP returns to a normal mode from an energy saving mode.

FIG. 6 is a timing diagram for explaining exemplary timings at which the control mechanism 110 and the engine control unit 120 perform various operations when the MFP 100 returns to the normal mode from the energy saving mode. The control mechanism 110 is booted and the OS is initialized when the MFP 100 returns to the normal mode from the energy saving mode. The control mechanism 110 receives a detection signal (from the energy-saving mode releasing switch 101, the pressure plate opening-closing sensor 102, or the document setting sensor 103) based on which the reason that prompted the MFP 100 to return to the normal mode is determined. Subsequently, the control mechanism 110 performs reactivation and opens the general-purpose PCI bus 140 for communication. The control mechanism 110 requires a time period t21 for determining the reason that prompts the MFP 100 to return to the normal mode, a time period t22 for reactivation, and a time period t23 for opening the general-purpose PCI bus 140 for communication. When the reason prompting the MFP 100 to return to the normal mode is determined, the control mechanism 110 transmits the normal-mode return triggering signal, the normal mode determining signal, and the elapsed time signal to the engine control unit 120 through the dedicated communication line 150.

The engine control unit 120 starts a process of activation after the control mechanism 110 determines the reason that prompts the MFP 100 to return to the normal mode. The engine control unit 120 requires a time period t24 for activation and a time period t25 for software setup. The process of controlling heating of the fixing unit 130 described above with reference to FIG. 3 is performed during the software setup. During the process of controlling heating of the fixing unit 130, the normal-mode return triggering signal, the normal mode determining signal, and the elapsed time signal can be referred to when necessary. Moreover, during the process of controlling heating of the fixing unit 130, the engine control unit 120 starts an activation control when it is determined necessary to activate the fixing unit 130.

Meanwhile, in a conventional configuration as shown for reference in FIGS. 5A and 5B, a control unit determines whether to heat a fixing unit and accordingly transmits an instruction to an engine control unit only after opening a general-purpose PCI bus for communication. Subsequently, the engine control unit starts a process of activation according to the instruction. In other words, even after the process of activation is complete, the engine control unit is not able to perform an activation control for the fixing unit unless the general-purpose PCI bus is opened for communication. In that case, the engine control unit needs to wait for a time period ta as in FIG. 5 or a time period tb as in FIG. 6 for the general-purpose PCI bus to open for communication. However, according to the above description of the embodiment, immediately after the process of activation and the process of software setup are complete, the engine control unit 120 is able to perform the activation control for the fixing unit 130 if it is determined necessary. Thus, the fixing unit can be heated up to the predetermined fixing temperature without wasting time and the image forming process can be efficiently performed.

Moreover, by determining whether to heat the fixing unit 130 based on the control mechanism booting signal, the normal-mode return triggering signal, the normal mode determining signal, and the elapsed time signal, it is possible to prevent unnecessary heating of the fixing unit 130 thereby saving power consumption.

Figure 7:
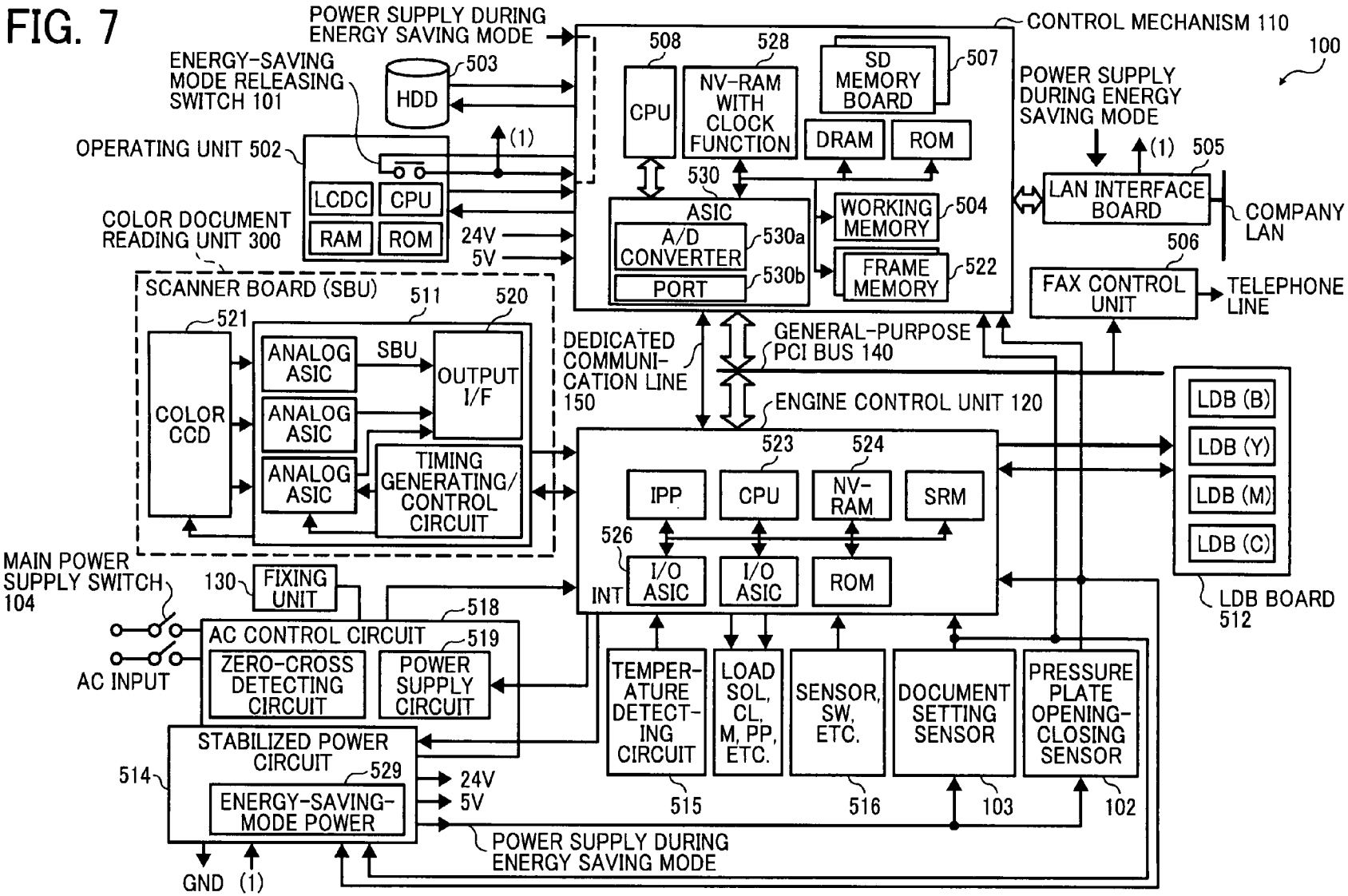
FIG. 7 is a schematic diagram for explaining an exemplary hardware configuration of the MFP.

FIG. 7 is a schematic diagram for explaining an exemplary hardware configuration of the MFP 100.

The control mechanism 110 in the MFP 100 is connected to an operating unit 502, a hard disk drive (HDD) 503 that is used to store image data, a local area network (LAN) interface board 505. The control mechanism 110 is also connected to a fax control unit 506 and the engine control unit 120 through the general-purpose PCI bus 140.

The MFP 100 includes a scanner board (SBU) 511 for reading an image from a document, a laser diode control board (hereinafter, "LDB board") 512 for writing image data on an image forming drum (not shown), a stabilized power circuit 514 that supplies power to the entire MFP 100, and an alternating current (AC) control circuit 518 that includes a zero-cross detecting circuit and a power supply circuit 519 that is used to supply power to the fixing unit 130.

The control mechanism 110 includes a central processing unit (CPU) 508, a secure digital (SD) memory board 507 that stores a control program for the control mechanism 110, a dynamic random access memory (DRAM) in which the control program is downloaded from the SD memory board 507, a read only memory (ROM) that stores basic operational programs, a working memory 504, a frame memory 522, a nonvolatile RAM (NV-RAM) 528 that has a random access memory (RAM) backup function and a clock function, an application specific integrated circuit (ASIC) 530, and an interface circuit. The working memory 504 and the frame memory 522 are working RAMs used by the CPU 508. The ASIC 530 is configured to control peripheries of the CPU 508 such as a system bus control for the control mechanism 110, a frame memory control, a first in first out (FIFO) control, a CPU control, and an input-output (I/O) control.

The working memory 504 is used when the printing function converts document data into image data. The frame memory 522 temporarily stores therein read image data or write image data that is to be immediately printed.

The clock function of the NV-RAM 528 counts a reference clock of 32, 768 hertz of an internal crystal, and accordingly outputs date and time. The CPU 508 sets into an input register of the NV-RAM 528 the date and time input from the operating unit 502. The NV-RAM 528 stores therein image forming setting information, mode setting information, fault status information about the fixing unit 130 and other constituent elements.

The stabilized power circuit 514 generates an energy-saving-mode power 529 and supplies it to only some of the constituent elements in the control mechanism 110 during the energy saving mode. The control mechanism 110 returns from the energy saving mode upon receiving a signal from the LAN interface board 505, a detection signal from the energy-saving mode releasing switch 101, a detection signal from the pressure plate opening-closing sensor 102, or a detection signal from the document setting sensor 103. Meanwhile, the LAN interface board 505 receives the energy-saving-mode power 529, while the energy-saving mode) releasing switch 101 is arranged in the operating unit 502.

The abovementioned signal from the LAN interface board 505, the energy-saving mode releasing switch 101, the pressure plate opening-closing sensor 102, or the document setting sensor 103 is also input in the stabilized power circuit 514 such that the stabilized power circuit 514 is activated. Upon activation, the stabilized power circuit 514 supplies power to the entire MFP 100 thereby releasing the MFP 100 from the energy saving mode.

The CPU 508 detects activation of the stabilized power circuit 514 by using an analog-to-digital (A/D) converter 530*a* in the ASIC 530.

When the stabilized power circuit 514 is activated, the control mechanism 110 determines the following conditions and accordingly transmits information to the engine control unit 120 through the dedicated communication line 150.

First, the control mechanism 110 determines whether the power is supplied thereto and accordingly transmits the control mechanism booting signal to the engine control unit 120.

Then, the control mechanism 110 determines whether the MFP 100 is in the normal mode because the main power supply switch 104 is switched ON or whether the MFP 100 has returned to the normal mode from the energy saving mode, and accordingly transmits the normal mode determining signal to the engine control unit 120. Moreover, if the MFP 100 has returned to the normal mode from the energy saving mode, the control mechanism 110 determines whether that is because of a user operation or due to a network access, and accordingly transmits the normal-mode return triggering signal to the engine control unit 120.

Furthermore, the control mechanism 110 determines whether the elapse in time after the previous image forming setting exceeds a predetermined time period, and accordingly transmits the elapsed time signal to the engine control unit 120. The engine control unit 120 controls heating of the fixing unit 130 based on the abovementioned information from the control mechanism 110.

The control mechanism 110 controls a plurality of functions such as the scanning function, the facsimile function, the printing function, and the copying function, and thus controls the entire MFP 100.

The control mechanism 110 analyzes the information input by a user from the operating unit 502 to perform the system setting of the MFP 100 and accordingly displays the status of the MFP 100 on a display unit (not shown). The general-purpose PCI bus 140 is connected to a plurality of constituent elements, and transmits image data and control commands through an image data bus/control command bus by performing time sharing.

The LAN interface board 505 is a communication interface that connects the control mechanism 110 to, e.g., a company LAN. Thus, the communication between the MFP 100 and an external device is performed through the LAN interface board 505. The LAN interface board 505 receives the energy-saving-mode power 529. When a signal is transmitted from the LAN interface board 505, the MFP 100 is released from the energy saving mode.

The HDD 503 is used as an application database to store system application programs, printing information, or image forming information, and as an image database that includes the image data or the document data.

Meanwhile, the MFP 100 also includes a color document reading unit 300 that scans a document by using a document illuminating light source (not shown) and forms an image by using a color charged-coupled device (CCD) 521. That is, the color CCD 521 performs photoelectric conversion of reflected light from the document to generate image signals in red (R), green (G), and blue (B).

The color CCD 521 is a three-line color CCD-configured to generate an image signal of R, G, and B in EVENch/ODDch (not shown). The scanner board 511 includes a plurality of analog ASICs and a timing generating/control circuit configured to generate a driving timing of the analog ASICs and the color CCD 521. The image signals are input to the analog ASICs. The output signal of the color CCD 521 is sampled and held by a sample-hold circuit (not shown) in each analog ASIC, and then subjected to analog to digital conversion to form RGB image data. Subsequently, the RGB image data is subjected to shading correction to obtain corrected image data. An output interface (I/F) 520 transmits the corrected image data to an image processing processor (IPP) in the engine control unit 120 through an image data bus.

The IPP is a programmable computing processor configured to perform image processing including a number of processes such as separational generation (determining whether an image is a character region or a photo region), real time thresholding (RTT), scanner gamma conversion, filtering, color correction, magnification, image processing, printer gamma conversion, and gradation processing. The image data from the scanner board 511 is subjected to correction against signal deterioration, which occurs due to the optical system and digital quantization (signal deterioration of a scanning system), in the IPP and then written in the frame memory 522.

The operating unit 502 includes a CPU, a ROM, a RAM, a liquid crystal display control unit (LCDC), which is an ASIC for controlling an LCD and a key input. A control program that controls input-output with respect to the operating unit 502 is stored in the ROM. The RAM is a working memory used by the CPU. The operating unit 502 receives user instructions regarding the system setting of the MFP 100, communicates with the control mechanism 110, and displays the system setting and the status of the MFP 100.

The working memory 504 outputs four write signals in black (B), yellow (Y), cyan (C), and magenta (M) to an laser diode (LD) writing circuit in the LDB board 512 connected to the engine control unit 120. The LD writing circuit performs an LD current control (modulation control) and outputs the LD current to each laser diode.

The engine control unit 120 mainly controls the image forming process of the MFP 100, and includes a CPU 523, the IPP, a ROM that stores therein a control program for copying and printout, a RAM that controls the ROM, and an NV-RAM 524.

The NV-RAM 524 includes a static RAM (SRAM) (not shown) and an electrically erasable programmable ROM (EEPROM) (not shown). When the power supply is turned OFF, the data is stored in the EEPROM; while when the power supply is turned ON, the data in the EEPROM is downloaded in the SRAM. The NV-RAM 524 stores therein information necessary to control the constituent elements of the engine control unit 120 before the general-purpose PCI bus 140 is opened for communication. The information stored in the NV-RAM 524 is, e.g., scanner initialization information, image forming setting information, temperature setting data of the fixing unit 130, fault status information about the fixing unit 130, and the like. The fault status information about the fixing unit 130 includes thermistor disconnection, failure in reloading the fixing unit 130, detection of high temperature, and the like. The temperature setting data of the fixing unit 130 includes the temperature of each fixing roller (not shown) arranged therein, a correction temperature corresponding to the thickness of a document passing therethrough, and the like. The NV-RAM 524 also includes a serial interface (not shown) for communicating signals with the CPU.

The engine control unit 120 includes an I/O ASIC 526 that is connected to a plurality of analog control circuits such as a motor for controlling the MFP 100, a solenoid (not shown), a clutch (not shown), the power supply circuit 519, a plurality of sensors (not shown) that control the MFP 100, a switch (not shown), the pressure plate opening-closing sensor 102, the document setting sensor 103, a toner finishing sensor (not shown), a P-sensor (not shown), a T-sensor (not shown), a temperature detecting circuit 515 for the heating motor, and the like.

The CPU 523 communicates commands with the control mechanism 110 through the general-purpose PCI bus 140 as well as receives the control mechanism booting signal, the normal-mode return triggering signal, the normal mode determining signal, and the elapsed time signal from the control mechanism 110 through the dedicated communication line 150 by using a port 530*b*.

As described above, the stabilized power circuit 514 supplies power for controlling the MFP 100. More particularly, when the main power supply switch 104 is switched ON, then the stabilized power circuit 514 supplies commercial power to the MFP 100. The CPU 523 outputs an energy-saving mode transition signal when a predetermined amount of time passes after completing, e.g., a copying process. Subsequently, the stabilized power circuit 514 generates the energy-saving-mode power 529 and stops supplying power except the energy-saving-mode power 529.

The AC control circuit 518 includes the zero-cross detecting circuit and the power supply circuit 519 that supplies power to the heating motor. The power supply circuit 519 is a triac driven circuit and supplies power based on a power supply signal output from the CPU 523 through the I/O ASIC 526. The zero-cross detecting circuit generates a zero cross signal that is input in an interrupt terminal (not shown) of the CPU 523. The CPU 523 generates the power supply signal based on the zero cross signal. An internal timer in the CPU 523 measures the time interval between each the power supply signal and accordingly detects a commercial frequency.

When the temperature of the heating motor in the fixing unit 130 is determined to have decreased, then the heating motor is turned ON by supplying power. At that time, there is a possibility that a high inrush current flows thereto. That may result in a problem such as flickering of the room lighting. To solve such a problem, a soft start method is implemented to gradually expand a phase angle while turning ON the heating motor. More particularly, it is necessary to even out the phase angle irrespective of whether the commercial frequency is 50 hertz or 60 hertz. For that, first, it is necessary to determine the commercial frequency. When the commercial frequency is determined to be 60 hertz, the heating motor is turned ON, e.g., 3.4 milliseconds sooner than when the commercial frequency is determined to be 50 hertz such that the phase angle evens out. At the time of releasing the MFP 100 from the energy saving mode, the commercial frequency registered in the NV-RAM 524 is used.

Meanwhile, a heating control program that is executed at the time of heating the fixing unit 130 can be stored in a computer connected to a network such as Internet and downloaded from the computer. Moreover, the heating control program can be distributed over the network such as Internet.

Furthermore, the heating control program can be stored in a ROM in advance.

The heating control program is stored as an installable and executable file in a computer-readable storage medium such as a compact disk ROM (CD-ROM), a flexible disk (FD), a CD recordable (CD-R), or a digital versatile disk (DVD).

The heating control program executed in the MFP 100 includes modules for each constituent element (e.g., the communication control unit 121 and the fixing control unit 122). In practice, a CPU reads the heating control program from a storage medium and executes the same such that the modules for each constituent element is loaded and generated in a main storage unit (not shown).

Meanwhile, it is possible to modify the embodiment in a plurality of ways.

For example, taking into consideration a case when the power supplied by the main power supply is insufficient, an auxiliary power supply can be arranged in the MFP. In that case, the MFP 100 can be configured such that the auxiliary power supply is used in addition to the main power supply only when a user performs an operation with respect to the MFP 100.

Figure 8:
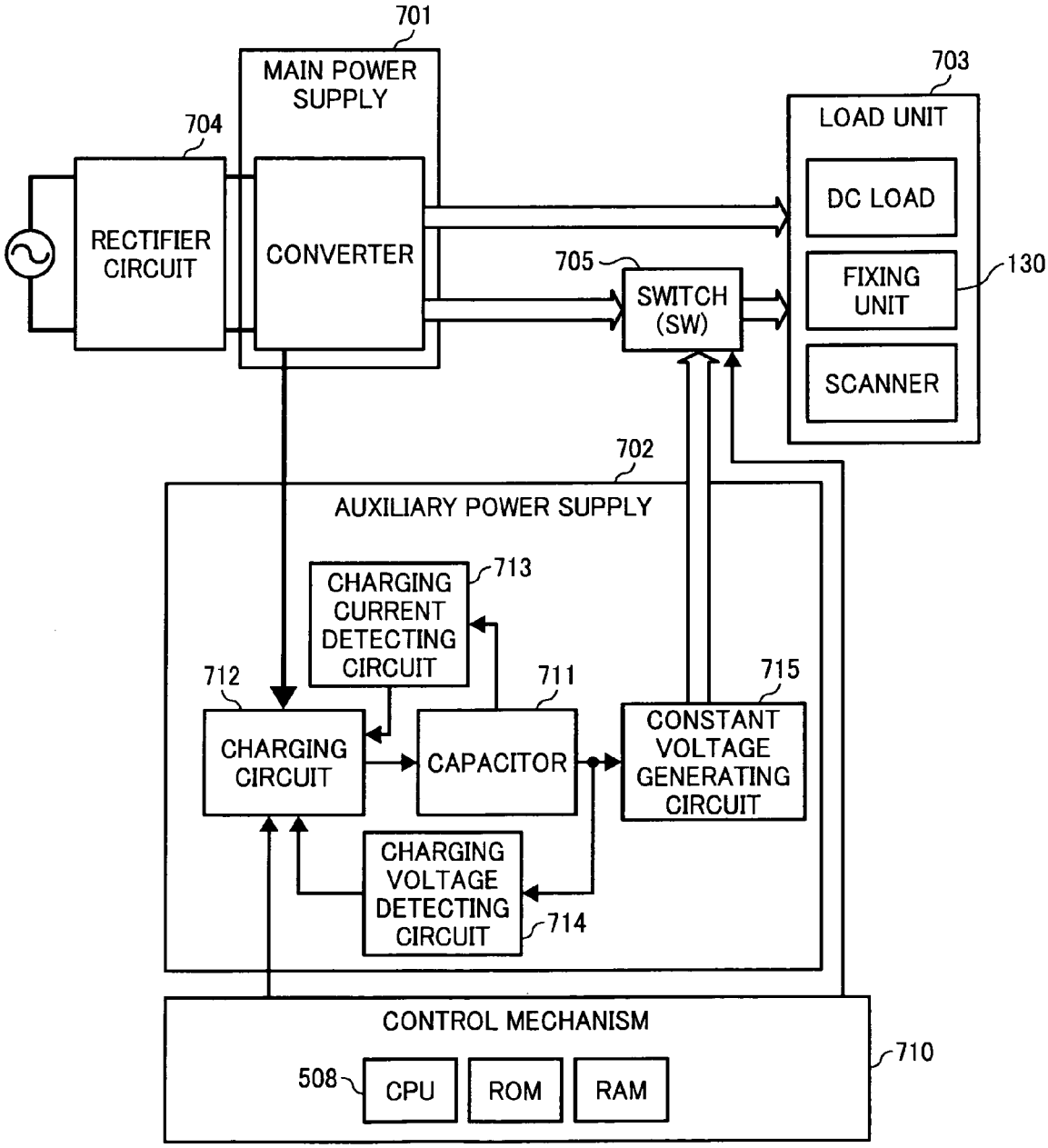
FIG. 8 is a schematic diagram of an MFP with an auxiliary power supply according to a modification of the embodiment.

FIG. 8 is a schematic diagram of an MFP with an auxiliary power supply according to a modification of the embodiment. As shown in FIG. 8, the MFP includes a main power supply 701, an auxiliary power supply 702, a load unit 703, a rectifier circuit 704, a switch (SW) 705, and a control mechanism 710. In FIG. 8, only those constituent elements of the MFP that are related to supplying power are described. The description of other constituent elements is omitted for simplification.

An alternating current subjected to full-wave rectification and smoothing is input in the main power supply 701. Subsequently, the main power supply 701 converts the alternating current into a direct current by using a converter, and transmits the direct current to the auxiliary power supply 702 and the load unit 703.

The auxiliary power supply 702 includes a capacitor 711, a charging circuit 712 that charges the capacitor 711, a charging current detecting circuit 713 that detects a charging current of the charging circuit 712, a charging voltage detecting circuit 714 that detects a charging voltage of the charging circuit 712, and a constant voltage generating circuit 715 that stabilizes the output voltage of the capacitor 711.

The load unit 703 includes the fixing unit 130, a scanning unit, and a direct current (DC) load, and receives power from either one of the main power supply 701 and the auxiliary power supply 702.

Based on the value in the normal-mode return triggering signal, the control mechanism 710 determines whether to instruct the auxiliary power supply 702 to supply power. More particularly, when "0 (low)" is set in the normal-mode return triggering signal, the control mechanism 710 operates the switch (SW) 705 such that the auxiliary power supply 702 supplies power to the load unit 703 in addition to the main power supply 701. The value "0 (low)" in the normal-mode return triggering signal indicates that the MFP 100 has returned to the normal mode from the energy saving mode due to a user operation. Thus, by using the main power supply 701 as well as the auxiliary power supply 702 in case of a user operation, it is possible to reduce the time required to activate the fixing unit 130.

When "1 (high)" is set in the normal-mode return triggering signal, the control mechanism 710 operates the switch (SW) 705 such that only the main power supply 701 supplies power to the load unit 703. The value "1 (high)" in the normal-mode return triggering signal indicates that the MFP 100 has returned to the normal mode from the energy saving mode due to a network access. In such a case, because it is not necessary to immediately activate the fixing unit 130, the auxiliary power supply 702 does not supply power to the load unit 703.

Meanwhile, although the above description is given with reference to an MFP, the present invention can also be implemented in any image forming apparatus such as a copying device, a facsimile device, a printer, and the like in which a fixing unit is used to form an image.

According to an aspect of the present invention, a user operation signal is transmitted to an engine control unit through a dedicated communication line such that the engine control unit can determine whether to heat a fixing unit based on the user operation signal. Thus, it is possible to heat the fixing unit only when necessary and activate the fixing unit immediately. Moreover, the wait time until the fixing unit is activated can be reduced. That results in improved operatability and saving in power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a fixing unit when heated fixes a toner image on a recording medium;

a detecting unit that detects a plurality of user's operations on the image forming apparatus and generates a plurality of detection signals respectively corresponding to the plurality of user's operations;

an engine control unit that controls operation of the fixing unit;

a communication control unit that receives the plurality of detection signals from the detecting unit;

a general-purpose communication line that becomes usable after being subjected to a set line-opening processing so as to connect the engine control unit with the communication control unit; and a dedicated communication line that connects the engine control unit with the communication control unit, wherein the detecting unit detects the user's operations, the communication control unit transmits the the plurality of detection signals respectively corresponding to the user's operations to the engine control unit through the dedicated communication line before the general-purpose communication line becomes usable, and the engine control unit determines based on the received detection signals whether to heat the fixing unit.

2. The image forming apparatus according to claim 1, wherein the detecting unit includes a power-saving mode releasing switch that is operated to release the image forming apparatus from the power-saving mode during which a power supply to the fixing unit is stopped or reduced, and the communication control unit receives from the power-saving mode releasing switch a detection signal, which is one of the plurality of detection signals, indicating that the power-saving mode releasing switch is operated.

3. The image forming apparatus according to claim 1, wherein the detecting unit includes a pressure plate opening-closing sensor that detects opening and closing of a pressure plate, and the communication control unit receives from the pressure plate opening-closing sensor a detection signal, which is one of the plurality of detection signals, indicating that the pressure plate is opened or closed.

4. The image forming apparatus according to claim 1, further comprising:

a document reading unit that reads a document; and an automatic feeding unit that feeds a document to the document reading unit, wherein the detecting unit includes a document setting sensor that detects setting of a document in the automatic feeding unit, and the communication control unit receives from the document setting sensor a detection signal, which is one of the plurality of detection signals, indicating that a document is set in the automatic feeding unit.

5. The image forming apparatus according to claim 1, further comprising a normal mode determining unit that determines whether the image forming apparatus has returned to a normal mode from a power-saving mode, the normal mode being a mode during which power is supplied to the image forming apparatus in entirety, the power-saving mode being a mode during which a power supply to the fixing unit is stopped or reduced, wherein the communication control unit transmits, when the image forming apparatus is determined to have returned to the normal mode from the power-saving mode, a normal mode determining signal indicating that the image forming apparatus is determined to have returned to the normal mode from the power-saving mode to the engine control unit through the dedicated communication line, and the engine control unit performs heating of the fixing unit upon receiving the normal mode determining signal and the user operation signal.

6. The image forming apparatus according to claim 1, further comprising a timer that measures an elapsed time after image forming setting is performed for the fixing unit, wherein the communication control unit transmits, when the elapsed time is determined to have exceeded a set time period, an elapsed time signal indicating that the elapsed time is determined to have exceeded the set time period to the engine control unit through the dedicated communication line, and the engine control unit performs image forming setting for the fixing unit upon receiving the elapsed time signal.

7. The image forming apparatus according to claim 1, further comprising:

an apparatus control unit that controls the image forming apparatus in entirety; and a power supply determining unit that determines whether power is supplied to the apparatus control unit, wherein the communication control unit transmits, when the power is determined to have been supplied to the apparatus control unit, a power supply signal indicating that the power is determined to have supplied to the apparatus control unit and the user operation signal to the engine control unit through the dedicated communication line, and the engine control unit performs heating of the fixing unit upon receiving the power supply signal and the user operation signal.

8. A method of controlling heating of a fixing unit in an image forming apparatus, the image forming apparatus including;

a fixing unit when heated fixes a toner image on a recording medium;

a detecting unit that detects a plurality of user's operations on the image forming apparatus and generates a plurality of detection signals respectively corresponding to the plurality of user's operation;

an engine control unit that controls operation of the fixing unit;

a communication control unit that receives the plurality of detection signals from the detecting unit;

a general-purpose communication line that becomes usable after being subjected to a set line-opening processing so as to connect the engine control unit with the communication control unit; and a dedicated communication line that connects the engine control unit with the communication control unit, the method comprising:

detecting the user's operations by the detecting unit;

transmitting by the communication control unit, the plurality of detection signals respectively corresponding to the user's operations to the engine control unit through the dedicated communication line before the general-purpose communication line becomes usable; and determining by the engine control unit based on the received detection signals whether to heat the fixing unit.

9. The method according to claim 8, wherein the detecting unit includes a power-saving mode releasing switch that is operated to release the image forming apparatus from the power-saving mode during which a power supply to the fixing unit is stopped or reduced, and the method further comprising the control unit receiving from the power-saving mode releasing switch a detection signal, which is one of the plurality of detection signals, indicating that the power-saving mode releasing switch is operated.

10. The method according to claim 8, wherein the detecting unit includes a pressure plate opening-closing sensor that detects opening and closing of a pressure plate, and the method further comprising the control unit receiving from the pressure plate opening-closing sensor a detection signal, which is one of the plurality of detection signals, indicating that the pressure plate is opened or closed.

11. The method according to claim 8, wherein the image forming apparatus further includes a document reading unit that reads a document; and an automatic feeding unit that feeds a document to the document reading unit, and the detecting unit includes a document setting sensor that detects setting of a document in the automatic feeding unit, and the method further comprising the communication control unit receiving from the document setting sensor a detection signal, which is one of the plurality of detection signals, indicating that a document is set in the automatic feeding unit.

12. The method according to claim 8, wherein the image forming apparatus further includes a normal mode determining unit that determines whether the image forming apparatus has returned to a normal mode from a power-saving mode, the normal mode being a mode during which power is supplied to the image forming apparatus in entirety, the power-saving mode being a mode during which a power supply to the fixing unit is stopped or reduced, the method further comprising:

the communication control unit transmitting, when the image forming apparatus is determined to have returned to the normal mode from the power-saving mode, a normal mode determining signal indicating that the image forming apparatus is determined to have returned to the normal mode from the power-saving mode to the engine control unit through the dedicated communication line; and the engine control unit performing heating of the fixing unit upon receiving the normal mode determining signal and the user operation signal.

13. The method according to claim 8, wherein the image forming apparatus further includes a timer that measures an elapsed time after image forming setting is performed for the fixing unit, the method further comprising:

the communication control unit transmitting, when the elapsed time is determined to have exceeded a set time period, an elapsed time signal indicating that the elapsed time is determined to have exceeded the set time period to the engine control unit through the dedicated communication line; and the engine control unit performing image forming setting for the fixing unit upon receiving the elapsed time signal.

14. The method according to claim 8, wherein the image forming apparatus further includes an apparatus control mechanism that controls the image forming apparatus in entirety; and a power supply determining unit that determines whether power is supplied to the apparatus control mechanism, the method further comprising:

transmitting by the communication control unit, when the power is determined to have been supplied to the apparatus control unit, a power supply signal indicating that the power is determined to have supplied to the apparatus control unit and the user operation signal to the engine control unit through the dedicated communication line; and heating by the engine control unit, the fixing unit upon receiving the power supply signal and the user operation signal.

* * * * *